US012215496B2

(12) United States Patent
Maslov

(10) Patent No.: US 12,215,496 B2
(45) **Date of Patent: *Feb. 4, 2025**

(54) EXTERIOR INSULATION PENETRATION EDGE FRAME AND COVER

(71) Applicant: Anatole Construction Company, Inc., Cleveland, TN (US)

(72) Inventor: Timothy Maslov, Cleveland, TN (US)

(73) Assignee: Anatole Construction Company, inc., Cleveland, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/518,165

(22) Filed: Nov. 22, 2023

(65) Prior Publication Data

US 2024/0084584 A1 Mar. 14, 2024

Related U.S. Application Data

(63) Continuation of application No. 17/512,601, filed on Oct. 27, 2021, now Pat. No. 11,859,381.

(60) Provisional application No. 63/106,304, filed on Oct. 27, 2020.

(51) Int. Cl.
*E04B 1/80* (2006.01)
*E04B 1/38* (2006.01)

(52) U.S. Cl.
CPC ..... *E04B 1/80* (2013.01); *E04B 1/38* (2013.01); *E04B 2001/386* (2013.01)

(58) Field of Classification Search
CPC ..... E04B 1/80; E04B 1/38; E04B 2001/386; E04B 1/7641
See application file for complete search history.

(56) References Cited

U.S. PATENT DOCUMENTS 2,930,505 A * 3/1960 Meyer ..... E04B 1/38 220/477
8,109,052 B2 * 2/2012 Rosende ..... E06B 1/6015 52/204.55
RE43,251 E * 3/2012 Anderson ..... E06B 3/9682 49/504
8,458,969 B2 * 6/2013 Richardson ..... E04G 15/02 249/19
8,495,843 B1 * 7/2013 Horneland ..... E06B 1/02 52/745.15

(Continued)

FOREIGN PATENT DOCUMENTS

CZ 17687 U1 * 8/2007
DE 202012010243 U1 * 3/2013 ..... E04B 1/7641

(Continued)

*Primary Examiner* — Rodney Mintz
(74) *Attorney, Agent, or Firm* — Shackelford, McKinley & Norton, LLP

(57) ABSTRACT

An external insulation penetration edge frame includes a frame portion constructed of an insulating material and comprising a front face, a rear face, an outside perimeter, an inside perimeter defining a frame opening, an outside portion extending from the outside perimeter toward the inside perimeter and an inside portion extending from internal edge toward outside edge, a mesh encapsulated in a base coat along the rear face, the inside perimeter, and the front face; and a plastic sheeting secured to the rear face of the inside portion and covering the frame opening.

10 Claims, 3 Drawing Sheets

(56) References Cited

U.S. PATENT DOCUMENTS 8,544,224 B1 * 10/2013 Hafendorfer ..... E06B 1/02 49/504
8,789,329 B2 * 7/2014 Radoane ..... E04B 2/88 52/746.1
8,931,220 B2 * 1/2015 Stewart ..... E06B 1/02 49/504
9,109,360 B2 * 8/2015 Stewart ..... E04B 1/98
9,677,270 B2 * 6/2017 Serino ..... B32B 27/308
9,739,084 B2 * 8/2017 Brooks, III ..... E06B 1/6038
10,208,485 B2 * 2/2019 Serino ..... E04F 13/0862
10,775,072 B2 * 9/2020 Duchet ..... E04C 2/246
11,859,381 B2 * 1/2024 Maslov ..... E04B 1/80
2009/0193729 A1 * 8/2009 Kustermann ..... E04B 2/8652 52/215
2010/0251643 A1 * 10/2010 Rosende ..... E06B 1/62 52/204.2
2010/0269433 A1 * 10/2010 Westra ..... E04G 15/02 52/215
2010/0281787 A1 * 11/2010 Jay ..... E06B 1/62 52/745.15
2010/0325984 A1 * 12/2010 Richardson ..... E06B 1/02 52/215
2011/0083382 A1 * 4/2011 Sanders ..... E06B 1/342 52/215
2011/0214370 A1 * 9/2011 Stewart ..... E06B 1/32 52/215
2011/0258944 A1 * 10/2011 Radoane ..... E04B 1/665 52/220.8
2012/0186172 A1 * 7/2012 Bouchard ..... E04D 13/064 52/585.1
2013/0186009 A1 * 7/2013 Hart ..... E06B 1/62 52/58
2013/0276391 A1 * 10/2013 Horneland ..... E06B 1/02 52/215
2013/0276404 A1 * 10/2013 Horneland ..... E06B 1/003 403/345
2014/0130431 A1 * 5/2014 Stewart ..... E06B 1/02 52/215
2014/0130432 A1 * 5/2014 Stewart ..... E06B 1/02 52/215
2015/0300005 A1 * 10/2015 Fetterman ..... E04B 1/7641 52/717.04
2015/0354208 A1 * 12/2015 Brooks, III ..... E06B 1/6038 52/745.15
2017/0067255 A1 * 3/2017 Serino ..... B32B 37/153
2017/0241131 A1 * 8/2017 Lewis ..... B05D 1/02
2018/0171641 A1 * 6/2018 Serino ..... E04F 13/073
2019/0063781 A1 * 2/2019 Duchet ..... F24F 13/0281
2020/0217063 A1 * 7/2020 Brooks, III ..... E04B 1/80
2022/0127844 A1 * 4/2022 Maslov ..... E04B 1/7641
2022/0154467 A1 * 5/2022 Mort ..... E04B 1/14

FOREIGN PATENT DOCUMENTS

DE 202014105293 U1 * 3/2016 ..... E04B 1/7641
EP 1990497 A2 * 11/2008 ..... E06B 1/345
EP 2339078 A2 * 6/2011 ..... E04B 1/762

* cited by examiner

EXTERIOR INSULATION PENETRATION EDGE FRAME AND COVER

TECHNICAL FIELD

This disclosure relates in general to exterior installation systems, and more specifically to an exterior penetration edge frame.

BACKGROUND

This section provides background information to facilitate a better understanding of the various aspects of the disclosure. It should be understood that the statements in this section of this document are to be read in this light, and not as admissions of prior art.

Exterior insulation finishing systems provide exterior walls with an insulated finished surface. This systems commonly use an insulated board that is secured to the exterior wall. The insulation board is subsequently covered with a reinforcing mesh and a base coat that forms a moisture barrier. A finish coat is applied on top of the primed base coat to provide a decorative finish.

Traditionally, installation of insulation board on the exterior wall, e.g., substrate, includes placement of starter board segments circumscribing the termination edges of penetrations in the substrate. The termination edge starter boards are cut on-site from insulation board to match the penetration profile. The termination edge starter boards are then fastened, via adhesive or mechanical fastener, to the substrate circumscribing penetration 14. The starter board insulation edge is then encapsulated with reinforcing mesh and a base coat. Subsequently a plastic sheeting is secured to the starter board to cover the penetration, in particular a window, in the penetration to protect from subsequent applications of material. This process is time consuming and results in significant amount of waste foam (insulation board), mesh and base coat produced at the construction site.

SUMMARY

An exemplary external insulation penetration edge frame includes a frame portion constructed of an insulating material and comprising a front face, a rear face, an outside perimeter, and an inside perimeter defining a frame opening.

Another exemplary external insulation penetration edge frame includes a frame portion constructed of an insulating material and comprising a front face, a rear face, an outside perimeter, an inside perimeter defining a frame opening, and a plastic sheeting secured to the rear face and covering the frame opening.

An exemplary external insulation penetration edge frame includes a frame portion constructed of an insulating material and comprising a front face, a rear face, an outside perimeter, an inside perimeter defining a frame opening, an outside portion extending from the outside perimeter toward the inside perimeter and an inside portion extending from internal edge toward outside edge, a mesh encapsulated in a base coat along the rear face, the inside perimeter, and the front face; and a plastic sheeting secured to the rear face of the inside portion and covering the frame opening.

An exemplary construction includes a wall having a substrate, a penetration extending through the substrate, a penetration frame comprising a front face, a rear face, an outside perimeter, and an inside perimeter defining a frame opening, the penetration frame secured to the substrate with rear face abutting the substrate the frame opening aligned with the penetration, and a plastic sheeting secured to the rear face and covering the frame opening.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
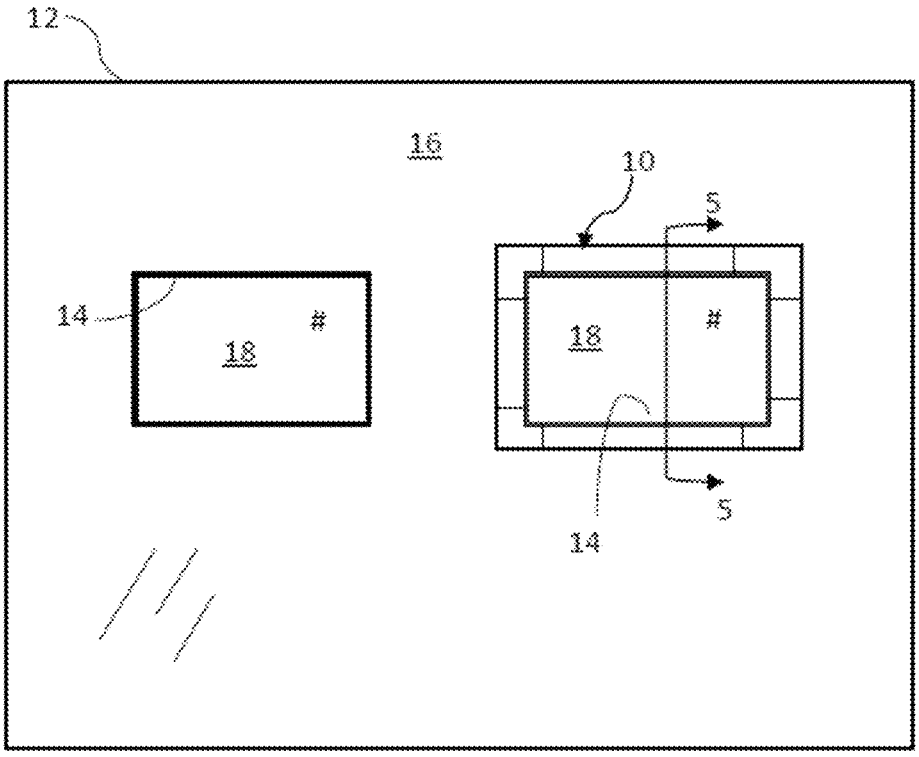
FIG. 1 illustrates an exemplary wall construction with wall penetrations in which the exterior insulation penetration frame can be implemented.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

FIGS. 1-5 illustrate exemplary aspects of an external insulation finishing system (EIFS) penetration frame, generally designated by the numeral 10. Penetration frame 10 is configured for installation at a penetration 14 in an exterior insulation system.

FIG. 1 illustrates a vertical wall 12 of a construction, such as a wall of building, with a penetration 14, in preparation for installation of an external insulation. Wall 12 is constructed of a substrate 16, e.g., concrete, masonry, stucco, brick, plywood, oriented strand board, cement board, glass mat ace gypsum sheathing, insulated concrete. Penetrations 14 are illustrated as window openings with windows 18 installed in the penetrations. Penetrations 14 are not limited to window openings and may include, for example, doors, light fixtures, hose bibs, dryer vents, and wall receptacles. FIG. 1 illustrates wall 12 and substrate 16 prior to installation of insulation board, for example expanded polystyrene board (EPS). Left penetration 14 illustrates a penetration prior to installation of a penetration frame and right penetration 14 illustrates an installed penetration frame 14.

Penetration frame 10 may be constructed offsite, or partially constructed offsite, for transport to and installation at a construction site. It is expected that penetration frame 10 will expedite the overall installation of external insulation systems by perhaps 25 to 35 percent. The back-wrapping process may eliminate 20, 30, or more percent of EPS foam, mesh, and base coat waste relative to traditional methods of installing insulated termination edge starter boards, thereby significantly reducing the volume of waste material that must be collected and hauled from a construction site.

Figure 2:
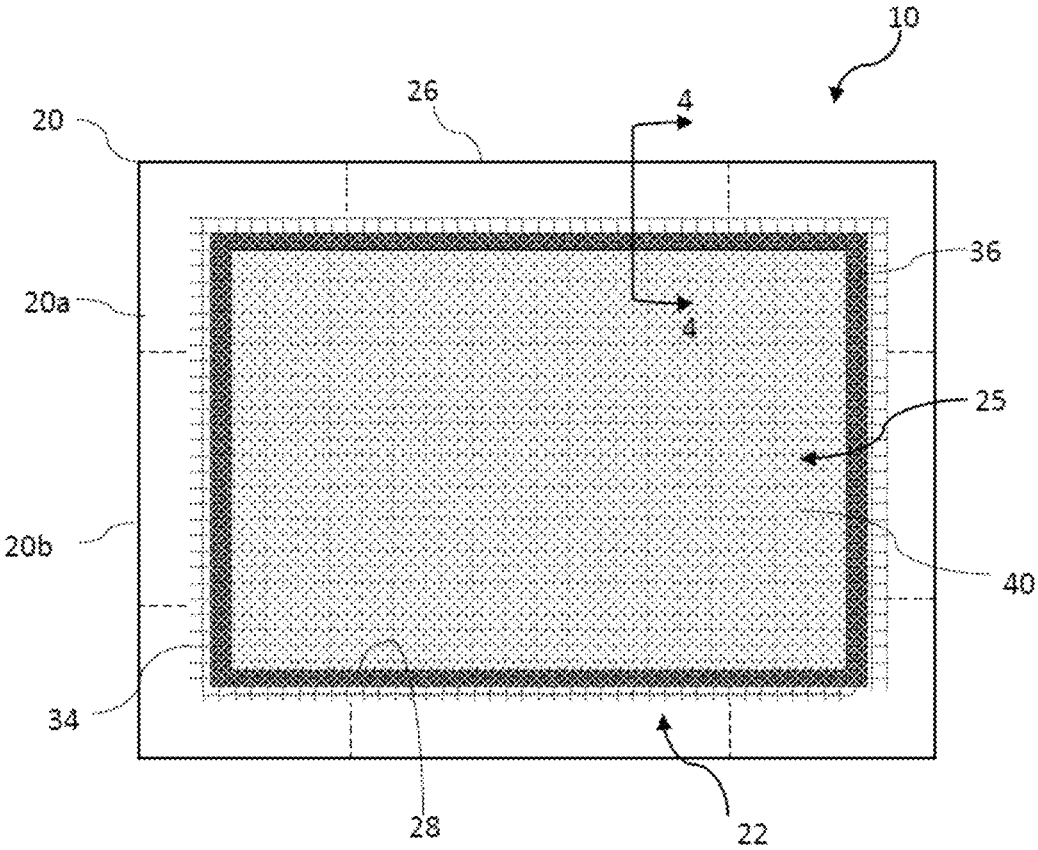
FIG. 2 is a front view of an exemplary exterior insulation penetration frame according to one or more aspects of the disclosure.
Figure 3:
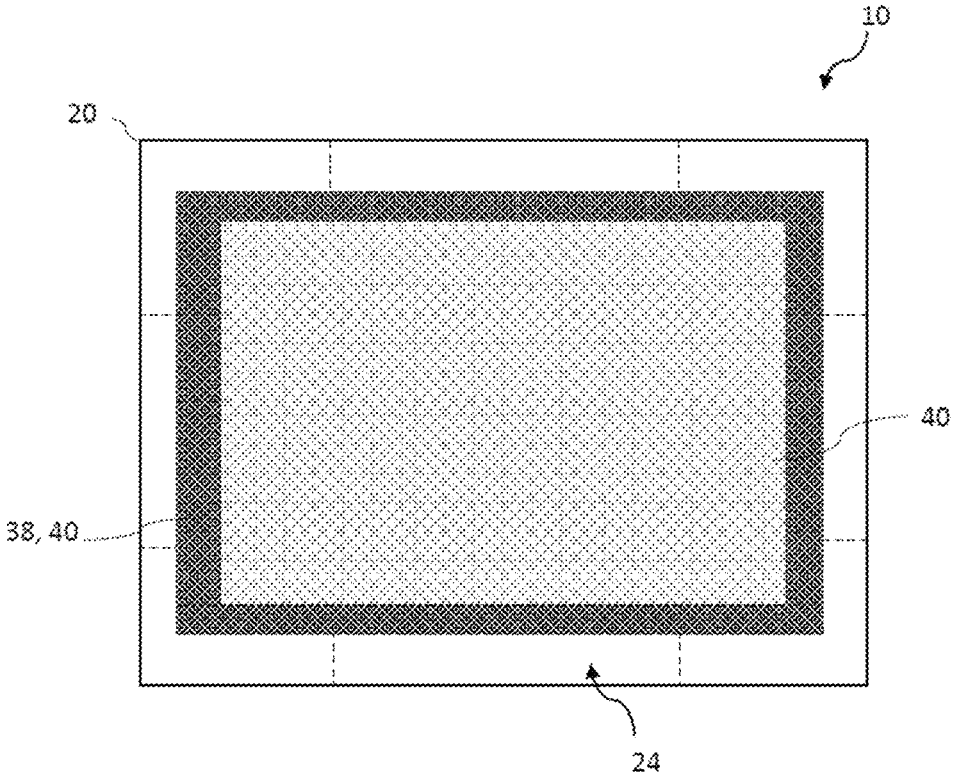
FIG. 3 is a rear view of an exemplary exterior insulation penetration frame according to one or more aspects of the disclosure.
Figure 4:
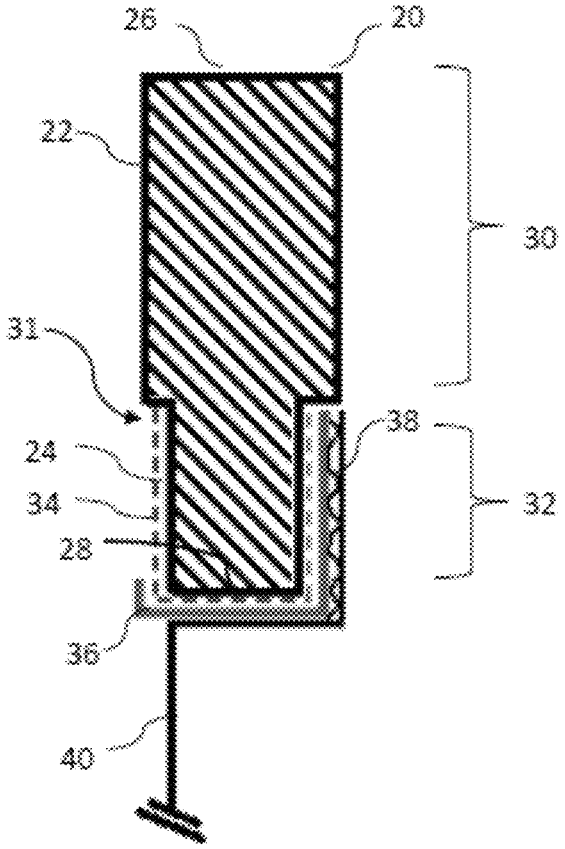
FIG. 4 is a section view of an exemplary exterior insulation penetration frame along the line 4-4 of FIG. 2.

FIGS. 2 and 3 illustrate, respectively, front side and rear sides of an exemplary EIFS penetration frame completed and ready for installation about a penetration. The rear side is configured for installation against the construction substrate. FIG. 4 is a sectional view along the line 4-4 of FIG. 2.

Penetration frame 10 comprises a frame portion 20 constructed of foam, e.g., EPS, in the shape of a construction penetration 14. Frame portion 20 includes multiple sections, including corners 20*a* and straight boards 20*b*, interconnected for example by an adhesive. In some embodiments, frame portion is cut from EPS boards, pre-coated boards, or pre-coated starter board shapes.

Frame portion 20 includes a front face 22, rear face 24, an outside perimeter 26, and an inside perimeter 28 defining a frame opening 25 to be placed over the penetration. Frame portion 20 includes an outside portion 30 extending from outside perimeter 26 toward inside perimeter 28 and an inside portion 32 extending from inside perimeter 28 toward outside perimeter 26. In an exemplary embodiment, inside portion 32 extends about two inches from inner perimeter 28. A notch 31 is formed along front face 22 and rear face 24 of inside portion 32 such that the width of outside portion 30 is greater than the width 32*a* of inside portion 32.

Inside portion 32 is back wrapped with reinforcing mesh 34 extending across front face 22, rear face 24, and inside perimeter 28. Mesh 34 is embedded in a base coat 36 on rear face 24, inside perimeter 28, and at least a portion of front face 22. Mesh 34 substantially fills notch 31. Plastic sheeting 40 is secured via an adhesive 38 along rear face 24 of inside portion 32. In an exemplary embodiment, sheeting 40 is not adhered to inside perimeter 28. In an exemplary embodiment, sheeting 40 is about 2-mil to 4-mil plastic. Sheeting 40 is sized such that it may be positioned toward front face 22 for example facilitating positioning a window or other penetration cover behind the plastic sheeting when penetration frame 10 is installed at a penetration.

Reinforcing mesh 34 may include a variety of materials as is known by those skilled in the art. For example, mesh 34 may be a reinforcing, strengthening, and/or first resistant mesh material such as fiberglass or polymer strand material. Non-limiting examples include polymer mesh such as polyester, polypropylene, aramid, and carbon. Base coat 36 may include a variety of material, for example, a polymer modified cementitious mortar.

Figure 5:
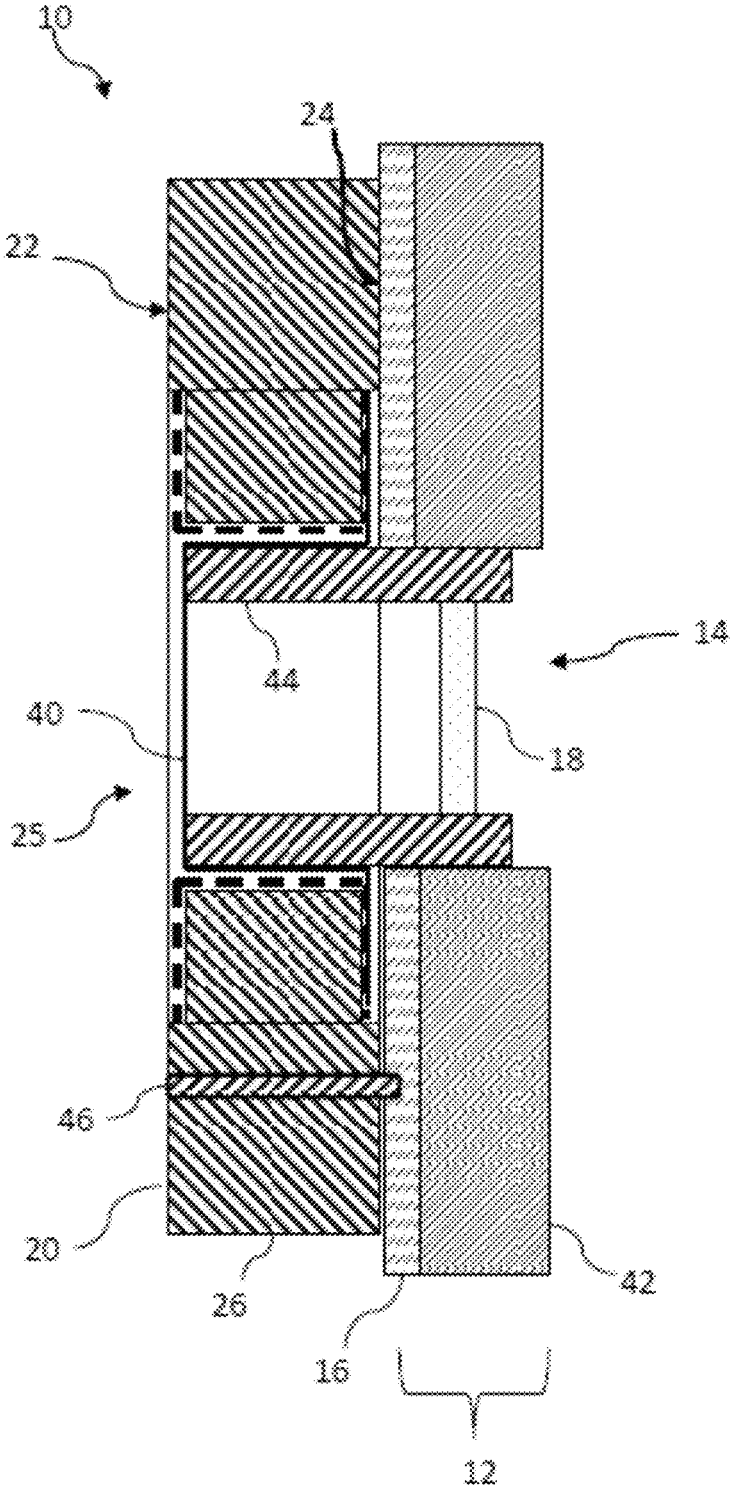
FIG. 5 is a section view of an exemplary exterior insulation penetration frame secured to a substrate along the line 5-5 of FIG. 1.

FIG. 5 is a sectional view along the line 5-5 of FIG. 1 illustrating an EIFS penetration frame 10 connected to a substrate at a penetration 14. Penetration edge frame 10 may be adhesively or mechanically connected to substrate 14, generally illustrated by the mechanical fastener 46. Rear face 24 is positioned against substrate 16, which may be supported on framing 42. Penetration opening 25 is coaxially aligned with penetration 14. In this example, penetration 14 is enclosed by a window 18 (e.g., glass pane). Window 18 is held in penetration 14 by a window frame 44. Plastic covering 40 is positioned between front face 22 and window 18 to protect window 18 from subsequent materials applied to the construction.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent as understood by a person of ordinary skill in the art.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A construction comprising:

a wall comprising a substrate;

a penetration extending through the substrate; and a penetration frame comprising a front face, a rear face, an outside perimeter, and an inside perimeter defining a frame opening, wherein an outside portion of the penetration frame extends from the outside perimeter toward the inside perimeter and an inside portion of the penetration frame extends from a recessed edge of the inside perimeter toward a proximal edge of the outside perimeter such that the outside portion has a thickness from the front face to the rear face that is greater than a thickness of the inside portion;

wherein the penetration frame is secured to the substrate with the rear face abutting the substrate such that the frame opening is aligned with the penetration.

2. The construction of claim 1, wherein the penetration frame comprises an expanded polystyrene board.

3. The construction of claim 1, wherein the penetration frame comprises expanded polystyrene foam.

4. The construction of claim 1, further comprising a plastic sheeting secured to the rear face and covering the frame opening, wherein the plastic sheeting is secured to the rear face along the inside portion and the plastic sheeting is not secured to the inside perimeter.

5. The construction of claim 1, further comprising a mesh encapsulated in a base coat along at least the rear face and the inside perimeter.

6. The construction of claim 5, wherein the mesh is encapsulated in the base coat along the rear face, the inside perimeter, and the front face.

7. The construction of claim 1, further comprising a plastic sheeting secured to the rear face and covering the frame opening.

8. The construction of claim 7, wherein the plastic sheeting is secured to the rear face along an inside portion and covers the frame opening.

9. The construction of claim 7, wherein the plastic sheeting is adhered to the rear face by an adhesive.

10. The construction of claim 7, wherein the plastic sheeting is not adhered or secured to the inside perimeter.

* * * * *